United States Patent [19]

Mailliet

Best Available Copy

[11] 4,266,907

[45] May 12, 1981

[54] DEVICE FOR HANDLING THE VARIOUS COMPONENTS OF AN INSTALLATION FOR THE INJECTION OF PRE-HEATED AIR INTO A SHAFT FURNACE

[75] Inventor: Pierre Mailliet, Howald, Luxembourg

[73] Assignee: Paul Wurth, S.A., Luxembourg

[21] Appl. No.: 927,583

[22] Filed: Jul. 24, 1978

[30] Foreign Application Priority Data

Jul. 29, 1977 [LU] Luxembourg ..... 77878
Jun. 22, 1978 [LU] Luxembourg ..... 77865

[51] Int. Cl.[3] ..... F27B 1/10

[52] U.S. Cl. ..... 414/687; 414/710; 414/745; 414/917; 414/743; 280/479 A; 266/270

[58] Field of Search ..... 414/589, 590, 543, 745, 414/746, 687, 688, 694, 695, 705, 753, 710, 917, 743; 266/270; 280/479 A

[56] References Cited

U.S. PATENT DOCUMENTS

| | | | |
|---|---|---|---|
| 1,543,214 | 6/1925 | Luce | 414/687 |
| 2,189,010 | 2/1940 | Lewis | 414/680 |
| 2,785,807 | 3/1957 | Prowinsky | 414/917 X |
| 2,825,477 | 3/1958 | Ross | 414/590 X |
| 3,095,981 | 7/1963 | Thorson | 414/680 |
| 3,409,158 | 11/1968 | Lull | 414/590 X |
| 3,477,596 | 11/1969 | Michaelson | 414/680 X |
| 3,515,298 | 6/1970 | Guinot | 414/705 X |
| 3,606,952 | 9/1971 | Mankey | 414/590 X |
| 3,727,774 | 4/1973 | Wolfe, Jr. | 414/473 |
| 3,980,286 | 9/1976 | Mahr | 266/270 |
| 4,087,084 | 5/1978 | Meyers | 414/753 X |
| 4,113,120 | 9/1978 | Pickrell | 414/352 X |

FOREIGN PATENT DOCUMENTS 2314120 7/1977 France .

*Primary Examiner*—Stephen G. Kunin
*Assistant Examiner*—Terrance L. Siemens
*Attorney, Agent, or Firm*—Fishman and Van Kirk

[57] ABSTRACT

The manipulation of components of a fluid transmission system, particularly portions of a conduit through which heated gas is delivered to a blast furnace is facilitated by the use of a self-propelled vehicle having mounted thereon a component support mechanism. The vehicle and component support mechanism cooperate to define a pair of displaced vertical pivotal axes whereby the component support mechanism can be readily maneuvered into engagement with the conduit portion to be manipulated. The apparatus is further characterized by a lifting arm assembly which enables the component support mechanism to be raised and lowered without changing the orientation of a supported conduit portion.

23 Claims, 31 Drawing Figures

38
40
40'
36
46'
43'
56
42'
30'
34'
32'
36
46
108
54
44
42
32
34
48
52
50
50
a
a

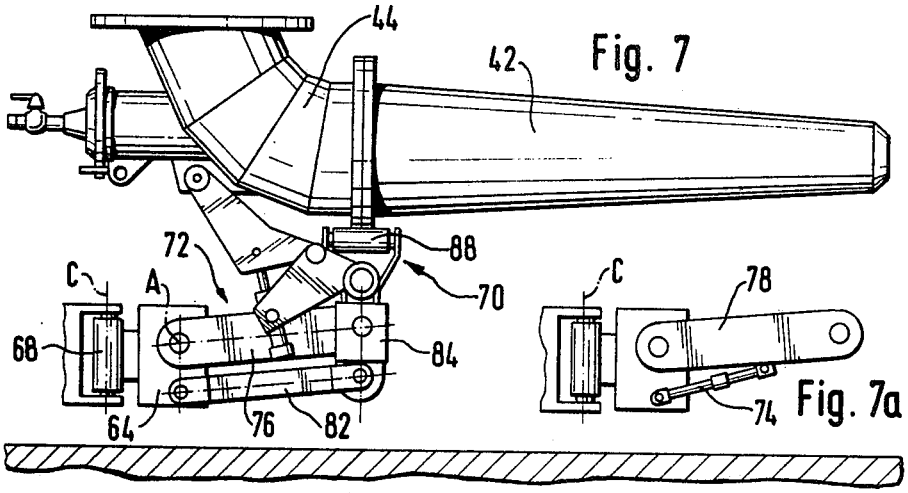
Fig. 7
Fig. 7a
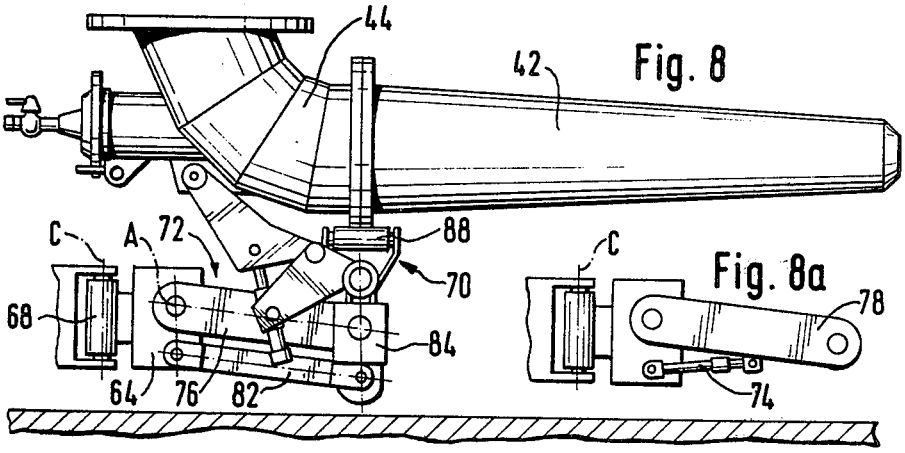
Fig. 8
Fig. 8a 40
44
54
106
92
88
96
100
B
104
90
86
102
94
112
110
114
116
84
42
36
70
82
76
78
72
80
A
C
98

Fig. 13
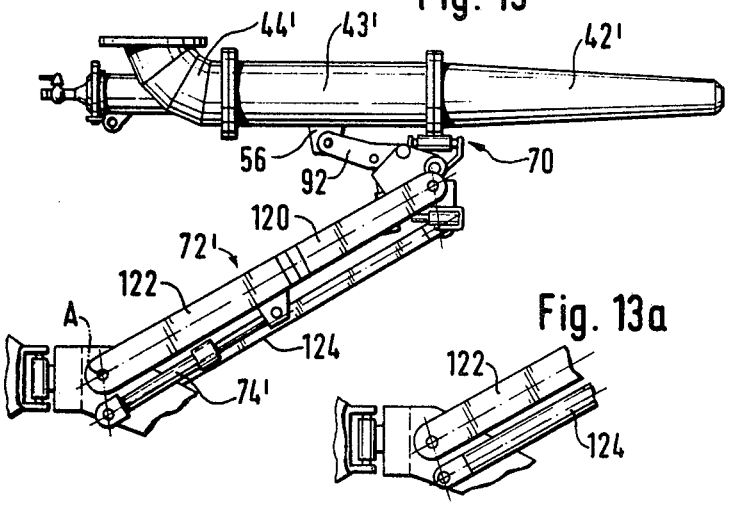
Fig. 13a
Fig. 14
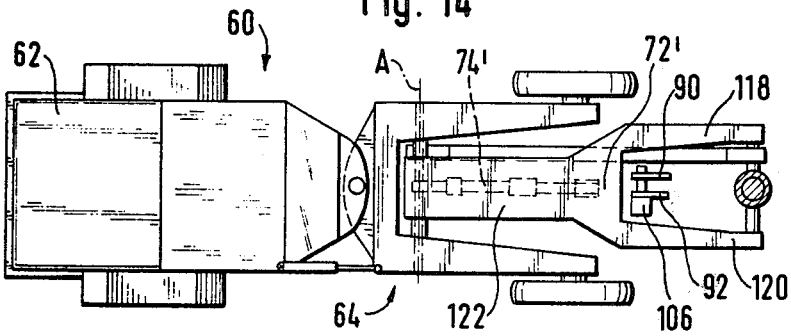

DEVICE FOR HANDLING THE VARIOUS COMPONENTS OF AN INSTALLATION FOR THE INJECTION OF PRE-HEATED AIR INTO A SHAFT FURNACE

The present invention relates to a device for handling the various components of an installation for the injection of pre-heated air into a shaft furnace. The invention likewise relates to a multi-purpose self-propelling carriage equipped with a device of this kind.

It is known that blast furnaces are fed, via a set of tuyeres which extend through the wall of the furnace, with heated air, known as hot blast, which may be enriched with oxygen. This hot air is introduced through a collecting pipe positioned around the furnace and is distributed in each of the tuyeres by means of separate distributors, known as blast pipes. These blast pipes have a descending part, inclined at a slight angle and incuding compensators to allow for thermal expansions, a substantially horizontal part, known as the nozzle which is applied against the tyere, and an elbow which connects the descending part to the nozzle via flanges.

In most furnaces all the tuyeres are situated on the same level and evenly distributed over the entire periphery of the furnace. Certain types of furnace, however, particularly those intended for the treatment of iron ore known as "minette", have two sets of tuyeres at different levels. In most cases there are only half as many tuyeres in the upper row as in the lower. In this case the blast pipes serving the tuyeres of the upper level have descending parts which are shorter than those of the lower blast pipes. On the other hand, the horizontal portion of the upper blast pipes, also known as the auxiliary blast pipes, is generally longer than that of the lower blast pipes, in order to render these blast pipes accessible. The fact is that the gap between the lower blast pipes impede access to the auxiliary blast pipes if these latter are entirely positioned between the wall of the furnace and the lower blast pipes. This is why the horizontal portion of the auxiliary blast pipes is lengthened by means of a crosspiece and the lower part of these auxiliary blast pipes is slightly offset in the radial direction in relation to the descending parts of the main blast pipes.

To render the tuyeres accessible, particularly in order to dismantle them, the lower part of the blast pipes first has to be removed, this lower part consisting of the elbow, the nozzle and possibly the crosspiece. This lower part is generally removed all in one piece by loosening the flanges between the elbow and the inclined descending part of the blast pipe.

These operations of dismantling, transporting, positioning and reassembling the blast pipe units have previously been carried out with the use of a self-propelling carriage, generally consisting of a fork elevator. A carriage of this kind requires a small turning circle and ample maneuverability, so that the platform provided for this purpose can be made to the smallest possible width. In this context, it should be possible, in particular, to position this carriage on the platform in such a way that it is aligned with the horizontal part of each blast pipe.

A carriage for use in the assembly and disassembly of blast pipe units must also enable the lower part of each blast nozzle to be dismantled and re-assembled regardless of the position and angle of inclination the part occupies as a result of thermally induced expansions and deformations.

A carriage of the type being discussed must also be so designed that it can be maneuvered rapidly and controlled with ease and above all in such a way as to satisfy all the safety requirements dictated by the operating environment. Even if the carriages hitherto used fulfil most of these conditions to a sufficient extent for medium-size blast furnaces, they are proving less and less satisfactory as the dimensions of the blast pipes increase as a result of the requirements arising out of the progress achieved in modern blast furnace construction. One of the main difficulties being encountered at the present time is due to the fact that, in the transport of the assembly consisting of elbow and nozzle, the centre of gravity of the complete unit formed by the carriage and its load is displaced by the load overhanging the fork of the carriage. In order to ensure that the centre of gravity will not move to a point beyond the wheels of the carriage, so that the latter will not tilt, the carriage has to be made sufficiently heavy or provided with counterweights. These measures obviously have to be taken at the cost of the performance of the carriage, particularly at the cost of the desired maneuverability and space-saving construction. These drawbacks become still more serious in the case of a furnace with two rows of tuyeres, the upper blast pipes forming a much longer load to be dismantled and supported on the carriage so that the known types of carriage may even fail to perform their function altogether.

These known carriages are, moreover, of no utility for dismantling and reassembling other components of an installation for the injection of pre-heated air into a shaft furnace such as the tuyeres or the descending sections of the feed lines connecting the circular pipe to the blast pipe elbow sections. The previously available carriages were at most suitable only for the transport of these components. However for dismantling and reassembling said components one has to resort to workmen or special single-purpose appliances.

SUMMARY OF THE INVENTION

The purpose of the present invention is to provide improved apparatus for handling the components of a gas transmission and/or injection system, and a carriage equipped with this apparatus satisfying the most exacting demands as regards maneuverability, reliability and safety and proving suitable both for the replacement of all types of lower and upper blast pipe component, where necessary, and for other purposes, i.e. capable of acting as a mechanical shovel.

According to the present invention there is provided a device for handling the various components of an installation for the injection of pre-heated air into a shaft furnace, said device being designed to be temporarily combined by means of a lifting arm with a control apparatus known per se, and being pivotable about a first vertical axis while the assembly consisting of the lifting arm and the handling device is pivotable about a second vertical axis distinct from the first.

In one preferred version the second vertical pivot axis is defined by a removable hinge connecting the lifting arm to the control apparatus.

The handling device may also be equipped with wheels and be designed to form the fore-carriage of the control apparatus which forms the hind-carriage.

The combination of the movements rendered possible by the two vertical swivel axes enables the handling device to be accurately aligned with the axis of the tuyere of the blast furnace, even if the axis of the control apparatus is offset or inclined in relation to that of the tuyere. This facilitates the manipulation of the carriage, in view of the usual comparative shortage of space available for this purpose. p According to a further embodiment of the invention there is provided a set of adapters designed to be temporarily associated with the said handling device on the one hand, and with each of the various components of the device for the injection of pre-heated air, on the other.

These adapters provide a means of dismantling and reassembling and also of transporting the descending part of the blast pipe, as well as the tuyere and even the assembly consisting of tuyere and nozzle in cases in which these two elements are integral with each other.

The invention also covers a multi-purpose self-propelling carriage, particularly for the handling of components of an installation for the injection of pre-heated air into a shaft furnace, comprising a chassis mounted on wheels and designed to be combined with each of the elements of a set of interchangeable working tools by means of a removable hinge providing a means of adjusting the orientation of the tool in relation to the chassis, characterized by the fact that at least one of the tools consists of a device such as defined aove and that the second swivel axis of the working tool is formed by the swivel axis of the said hinge.

The handling device or its adapter preferably comprises means for securing a component of the installation to the carriage. These means may consist of two parallel arms mounted on the handling device and capable of pivoting about a substantially horizontal axis and by a pin designed to interact with the holes in the said arm and an oblong hole in a bracket provided for this purpose on the component.

According to a further embodiment of the invention the handling device can be associated with a pneumatic or hydraulic tool for releasing the tuyere.

BRIEF DESCRIPTION OF THE DRAWING

Further features and characteristics of the invention will emerge from the following detailed description of certain embodiments thereof by way of an example and by reference to the accompanying drawings, in which:

FIGS. 7 and 8 show the handling devices associated with a blast pipe component in two different vertical positions.

FIGS. 7*a* and 8*a* show the control of the pivoting movement of the lifting arm.

FIGS. 13,13*a* and 14 are different views of a lifting arm for the handling of particular blast pipes.

The same reference number has been used for one and the same component throughout the figures.

DESCRIPTION OF THE PREFERRED EMBODIMENTS

Figure 1:
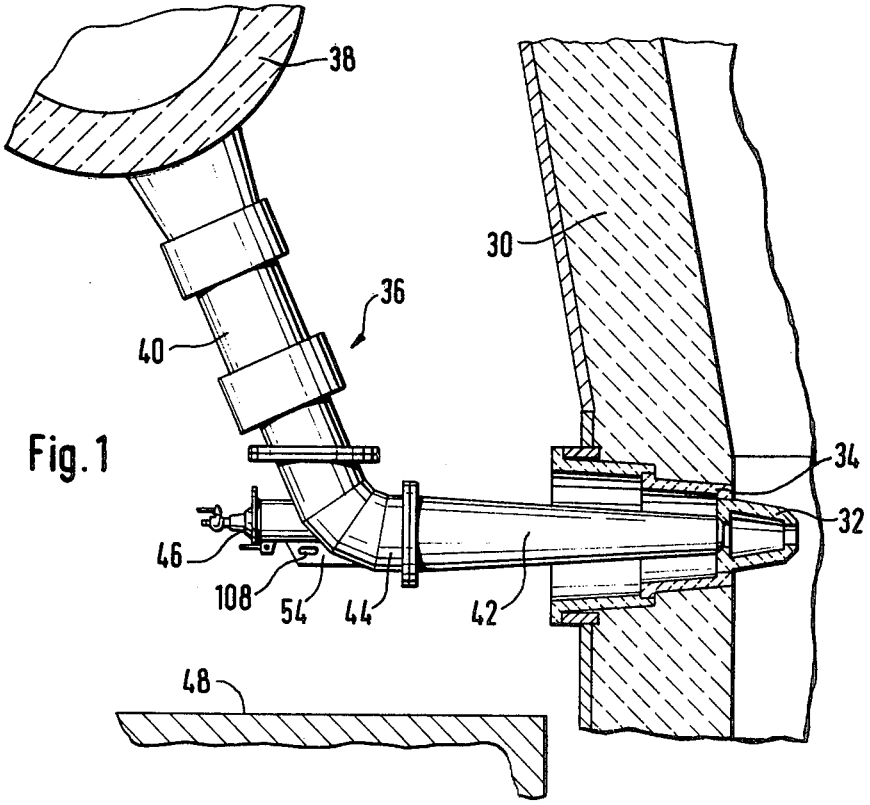
FIG. 1 is a general view of a blast pipe associated with a blast furnace tuyere.

FIG. 1 shows a partial general view of the environment in which a carriage according to the present invention moves and operates. This figure shows part of a wall 30 of a blast furnace, by a vertical section passing through a tuyere 32 mounted in a tymp 34. The reference number 38 identifies part of a circular hot-air piping system positioned around the blast furnace and transmitting the hot air to the tuyere through a blast pipe 36. This blast pipe 36 mainly consists of an inclined descending pipe 40, of a nozzle 42 applied against the tymp 34 via a tight joint and of an elbow 44 affixed by flanges to the lower end of the pipe 40 and also to the outer end of the nozzle 42. The elbow can also be provided with an inspection hole 46 enabling the injection of the hot air to be observed. Access to the blast pipe 36 is afforded by a platform 48 passing all the way round the furnace.

Figures 2, 2A:
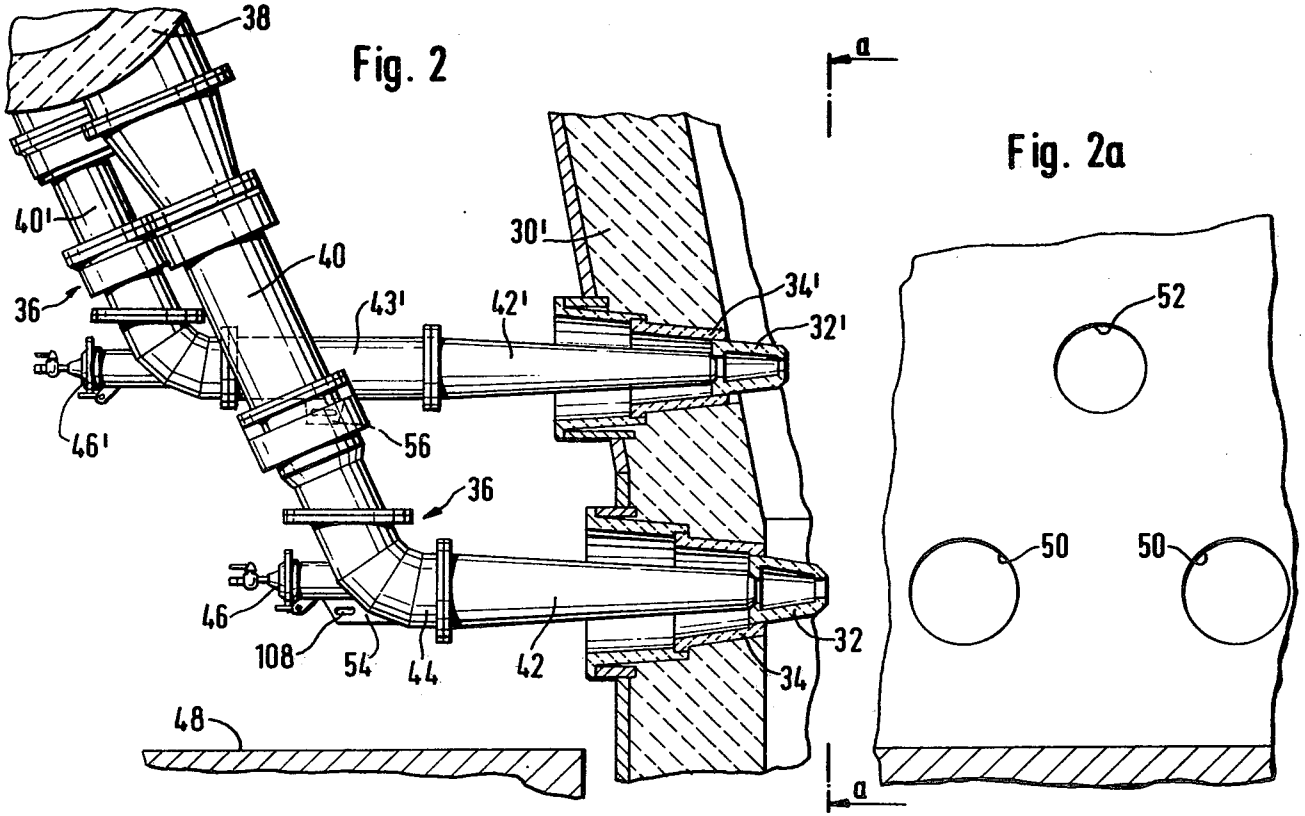
FIG. 2 is a partial view of an assembly wherein blast-pipes for a particular furnace are arranged on two levels.
FIG. 2*a* is a schematic diagram of the arrangement of the tuyeres accoding to FIG. 2.

FIG. 2 is a view similar to that provided in FIG. 1 of a blast furnace with two vertically displaced rows of tuyeres. As described above, the furnaces with two rows of tuyeres are necessary for certain types of ore, such as "minette". FIG. 2*a* is a view, from the interior of the blast furnace, of the wall of the latter, in the direction indicated by the arrows a—a in FIG. 2, and shows the arrangement of the tuyere orifices. As may be seen, the upper orifices 52 are offset in relation to the lower orifices 50.

The blast pipes designed to feed the lower tuyeres are identical with the blast pipe shown in FIG. 1, and the lower blast pipe of FIG. 2 is thus likewise marked 36, its various components bearing the same reference numbers as in FIG. 1. The upper blast pipe is likewise identified by the same reference numbers as the lower blast pipe but with the addition of a tick, in order to enable the two pipes to be distinguished. The horizontal portion of the upper blast pipe 36' is longer than the corresponding portion of the lower blast pipe 36. This extension is provided by the introduction of a crosspiece 43' between the nozzle 42' and the elbow 46'. On the other hand, the descending part 40' of the blast pipe 36' is shorter than the part 40 of the blast pipe 36. The two blast pipes 36 shown in FIGS. 1 and 2 each comprise a bracket 54 integral with the elbow 44. This bracket 54, which is provided with a slot, is used, as will be described in greater detail hereinafter, for the purpose of affixing the assembly consisting of elbow and nozzle to the self-propelling carriage. For the same reasons, the blast pipe 36' is also provided with a bracket 56, this latter, however, being provided on the intermediate crosspiece 43'.

Figure 3:
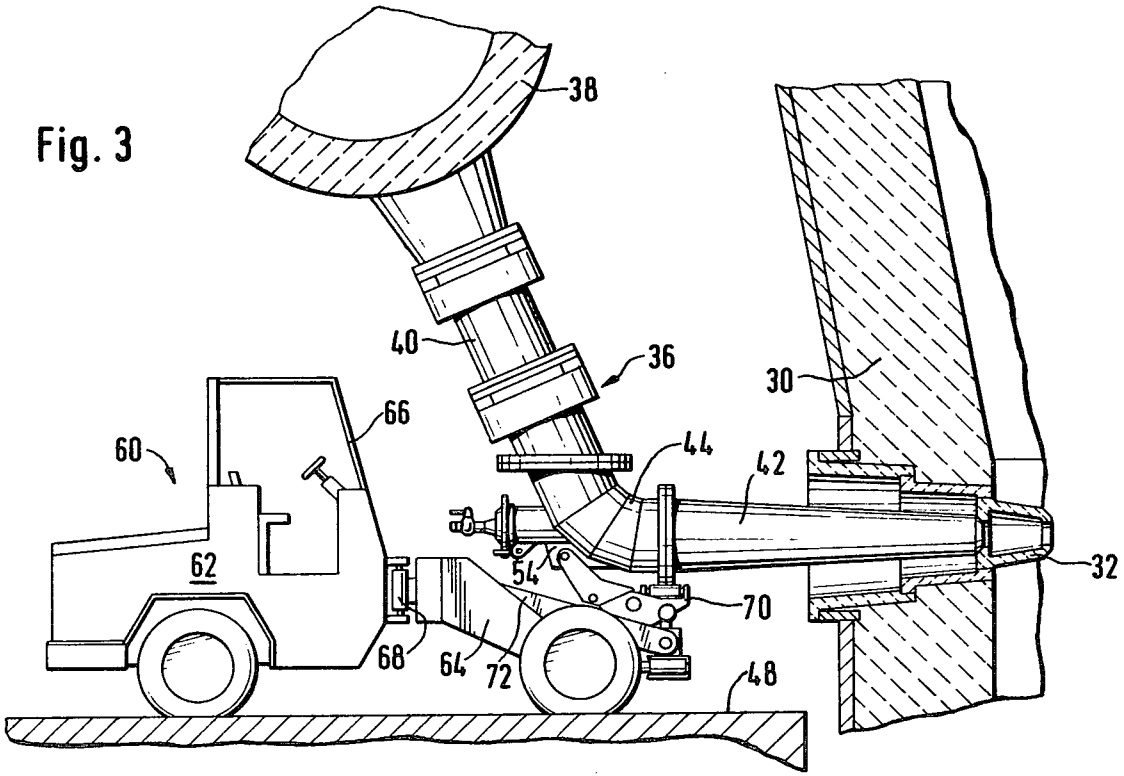
FIG. 3 shows a carriage designed for the handling of a normal blast pipe of the type depicted in FIG. 1.

FIG. 3 shows a general view of a carriage 60 situated on the platform 48 in the position required for mounting or dismantling a nozzle-and-neck unit 42–44 of a blast pipe 36. The carriage 60 mainly consists of a hind carriage 62 with a driver's cab 66 and a forecarriage 64 connected to the hind carriage 62 by means of a hinge 68. The terms "hind carriage " and "fore carriage" have been obviously adopted in view of the direction in which the driver's carriage 66 faces, and these terms could be interchanged. Both the fore-carriage 64 and the rear carriage 62 are mounted on a train of wheels, preferably with pneumatic tires.

The hinge 68 between the hind carriage 62 and the fore-carriage 64 is removable, and the said fore-carriage 64 can be replaced, in a manner known per se, by another fore-carriage 64 fitted with other accessories and designed to perform different tasks from those illustrated in the drawings.

Throughout the remainder of the description, however, the carriage will invariably be identified by the reference numeral 60, independently of the working tool or fore-carriage which it comprises.

The fore-carriage 64 in FIG. 3 is equipped with a handling device 70 suitable for mounting and dismantling the type of blast nozzles 36 described in the foregoing. This handling device 70 can be moved by hydraulic means between a raised position and a lowered position (see FIGS. 7 and 8). The height of the fore-carriage and of the device 70 in their lowered position may be such that any fore-carriage 64 can be maneuvered at least partly underneath the elbow 44 and the nozzle 42, in the manner shown in FIG. 3 and described in greater detail farther on.

Figure 4:
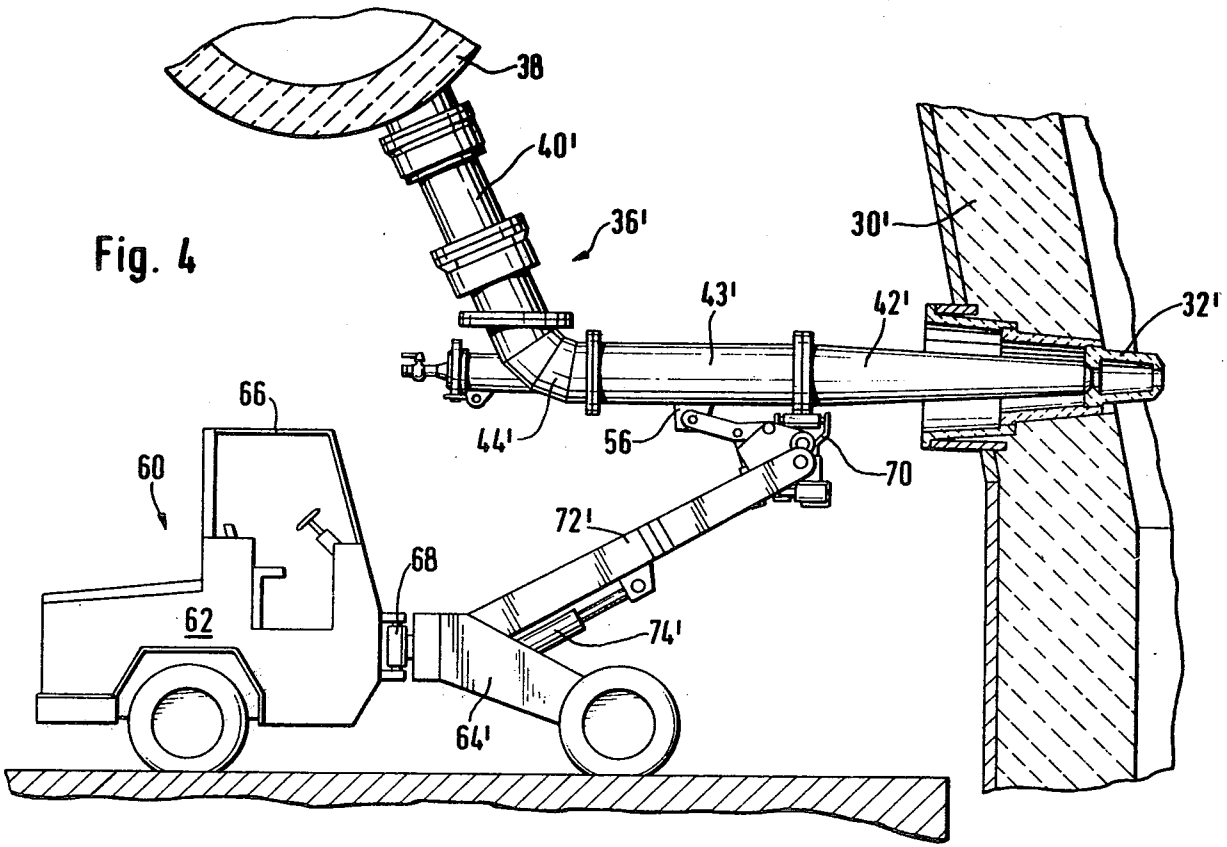
FIG. 4 shows a carriage for the handling of blast pipes of the type depicted in FIG. 1.

FIG. 4 shows a carriage 60 comprising a fore-carriage 64' articulated to the hind carriage 62 by means of the hinge 68. The fore-carriage 64' is designed for the mounting and dismantling of blast pipes of a type 36' and 36 as defined in the foregoing. The fore-carriage 64' can thus be used in the particular case of blast furnace installations equipped with two rows of tuyeres, while the fore-carriage 64 can be used in the so-called "normal" case of a blast furnace only possessing one single row of tuyeres. It should be noted, however, that the fore-carriage 64', as shown in the subsequent drawings, is equally suitable for the manipulation of the components of the upper blast pipes and the components of the lower blast pipes.

The difference between the two fore-carriages 64 and 64' resides in the length of the lifting arm, on the end of which is mounted the handling device, which is the same for the two fore-carriages. In the case of the fore-carriage 64 the handling device 70 is affixed to the end of a comparatively short lifting arm 72, whereas in the case of the fore-carriage 64' a comparatively long lifting arm 72' is provided, the purpose being to enable the handling device 70 to rest on the lower unit of the blast pipe, in the position approximately underneath the centre of gravity of this assembly. It should be noted that the point of contact between the blast pipe and the handling device 70 is defined by the position of the brackets 54 and 56. In the case of the blast pipe 36 the supporting action is provided by means of the flanges between the elbow 44 and the nozzle 42, while in the case of the blast pipe 36' the supporting action is provided by means of the flanges between the nozzle 42' and the crosspiece 43'.

The action of pivoting the lifting arm 72' is effected by the aid of a hydraulic jack 74' actuated from the driver's cab 66. In the case of the fore-carriage 64 the arm 72 is pivoted, in a similar manner, by means of the hydraulic jack not shown in FIG. 3.

Figure 5:
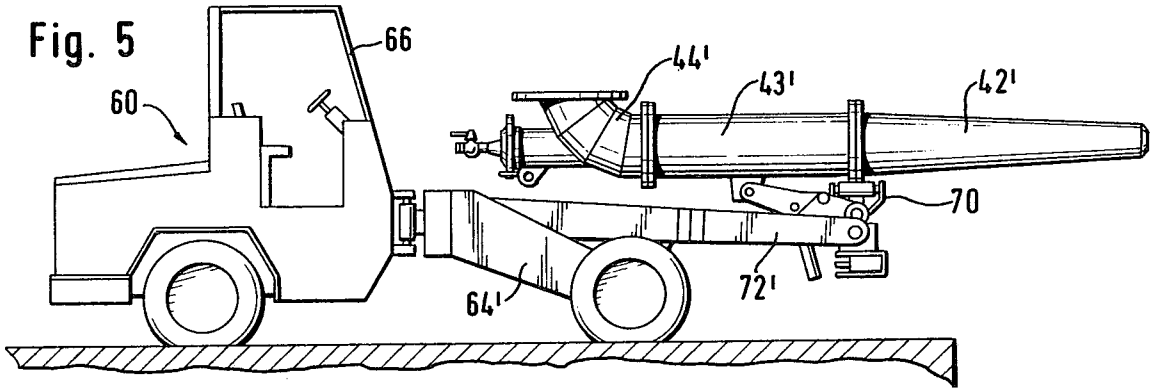
FIGS. 5 and 6 show the carriage according to FIG. 4 during the handling of each of the two types of blast pipe.
Figure 6:
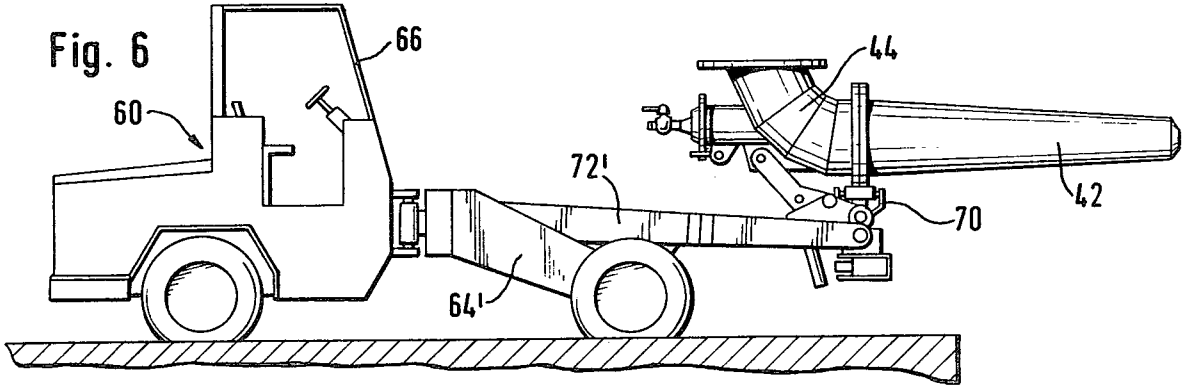

FIGS. 5 and 6 respectively show a nozzle-crosspiece-elbow unit of a blast pipe 36' and a nozzle-elbow unit of a blast pipe 36, in each case attached to the handling device 70 of the fore-carriage 64'. In both cases these blast pipe components are shown in the transport position in which the lifting arm 72' is lowered. In this position the driver in the driver's cap 66 does not find his vision obstructed by the load attached to the handling device 70, although visibility is often impeded in this way in the carriages at present in use.

A more detailed description will now be given of the design and operation of the handling device 70 mounted on a fore-carriage 64 of the so-called "normal" type, i.e. the type intended for the blast pipes 36. For this purpose FIGS. 7 to 12 will be referred to simultaneously. The lifting arm 72 is preferably U-shaped, with two lateral branches 76 and 78 interconnected by a shaft 80. Shaft 80 is supported on the fore-carriage 64 in such a way that arm 72 can pivot about the longitudinal axis A of shaft 80 which is customarily substantially horizontal (see FIG. 11 in particular). Between the free ends of the two lateral branches 76 and 78 the handling device 70 is mounted in a support block 84 (FIGS. 7 and 8). In order to ensure a constant permanent angle of inclination for the handling device 70 the support block 84 is connected to the fore-carriage 64 by a supplementary rod 82. This rod is parallel to the two branches 76 and 78 of arm 72, in order to define a parallelogram type linkage. The handling device 70 and its load will thus always move parallel to each other during the pivoting of the lifting arm about the axis A (in which connection FIG. 7 should be compared with FIG. 8).

The jack 74 designed to pivot the lifting arm 72 bears on one of the branches, e.g. the branch 78 (see FIG. 7*a* and 8*a*) of arm 72 and the force exerted by this jack is evenly distributed over the two branches 76 and 78 by the connecting shaft 80.

Figures 9, 10, 11, 12:
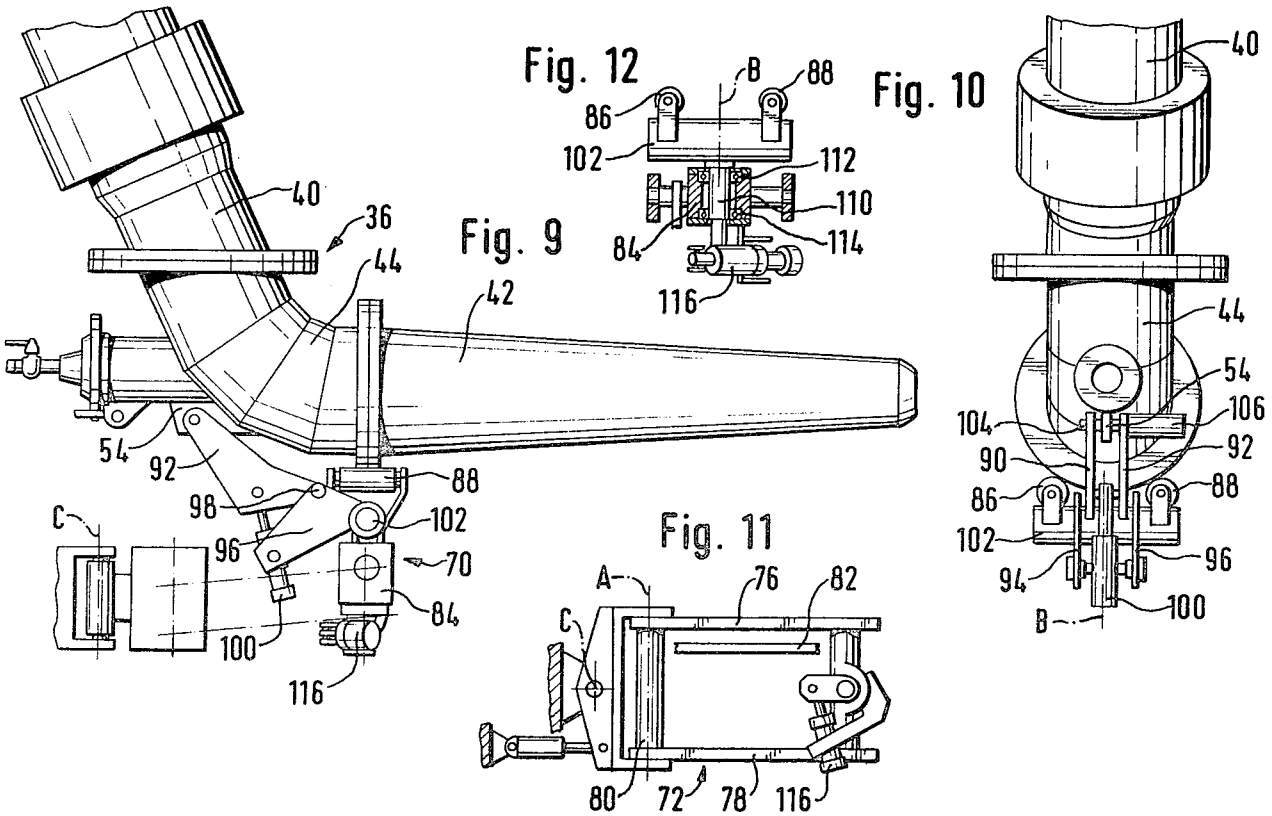
FIG. 9 provides a side view of the handling device.
FIG. 10 shows the latching device between the blast pipe and the handling device.
FIGS. 11 and 12 illustrate details in connection with the pivoting movement performed by the handling device about its vertical axis.
Figure 15:
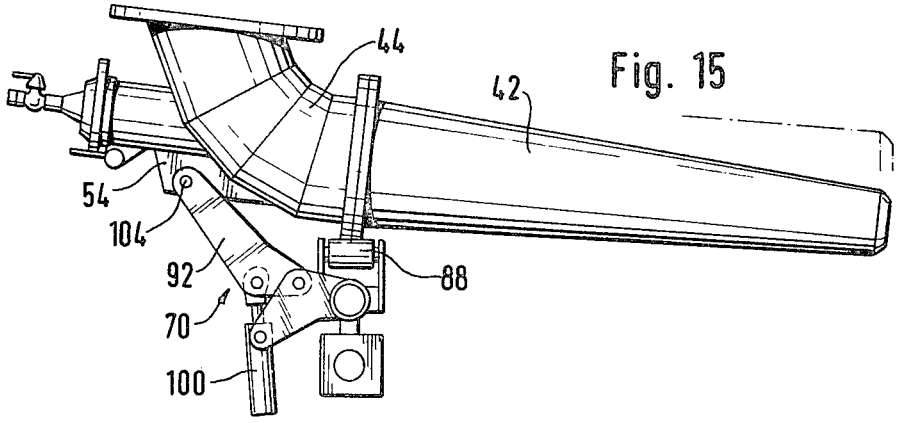
FIGS. 15 and 16 show different ways in which the latching action can be effected, thanks to the mobility of the latching system.

To enable it to support the load, the handling device 70 is equipped with two rollers 86 and 88 (see FIGS. 10 and 12). The gap between these two rollers 86 and 88 will be a function of the diameter of the pipe flanges to be engaged. These rollers enable the device to be correctly supported whatever the position and angle of inclination of the lower portion of the blast pipe, as well as a rotation of this portion about the longitudinal axis of the nozzle during the mounting operation, as will be described in greater detail farther on.

The operation of affixing the lower portion of the blast pipe to the handling device 70 is rendered possible by the bracket 54, forming part of the elbow 44, on the one hand, and by two movable arms 90 and 92, on the other, these latter being capable of pivoting about a shaft 98 held between two cheeks 94 and 96 integral with the body 102 of the handling device 70 bearing the two rollers 86 and 88. The latching of the bracket 54 between the arms 90 and 92 is effected by means of a pin 104 which can be caused to engage the said arms 90 and 92 via the apertures and also by means of a slot 108 (see also FIGS. 1 and 2) provided in the said bracket 54. This pin 104 can be engaged and disengaged manually or, in one advantageous embodiment, actuated by means of a small hydraulic jack 106 (FIG. 10) controlled from the driver's cabin 66 of the carriage. In this case it is the rod of the jack 106 that forms the pin 104.

As will be described in greater detail in due course, the mobility of the arms 90 and 92 and also the oblong shape of the slot 108 in the bracket 54 enable the latter to be latched to the handling device 70 whatever the angle of inclination of the blast pipe 36. For this purpose the two arms 90 and 92 are actuated by means of a hydraulic jack 100 mounted on a pivot between the cheeks 94 and 96. This jack 100 causes the arms 90 and 92 to pivot about their shaft 98 in order to enage the pin 104. The opening between the two branches 76 and 78 of the lifting arm 72 enables the jack 100 to be manipulated and the two arms 90 and 92 to be pivoted.

To ensure the correct positioning of the rollers 86 and 88 in relation to the blast pipe, the body 102 of the handling device 70 is mounted in such a way that it can rotate about a vertical axis B parallel to the axis C of the hinge between the front part 64 and the rear part 62 of the carriage 60. For this purpose the body 102 is integral with the shaft 110 passing vertically through a boring in the support block 84 accomodated in bearings 112 and 114 in such a way that it can pivot about the axis B. This pivoting movement is effected by means of a hydraulic jack 116 which is integral with the block 84 and of which the mobile part causes the handling device to move about the vertical axis B (see FIGS. 11 and 12).

FIGS. 13, 13*a* and 14 show the arrangement of a fore-carriage 64' designed for the handling of components of a blast pipe of type 36'. The handling device 70 is identically similar to that associated with the fore-carriage 64 and described above. The only difference resides in the supporting and fixing position for an assembly consisting of the elbow 44', the crosspiece 43' and the nozzle 42'. However, the flanges are supported between the nozzle 42' and the crosspiece 43' and the assembly is fixed between the bracket 56 and the two arms 90 and 92 in the same manner as described in the foregoing. The difference between the two versions is to be found at the level of the lifting arm 72'. The fact is that since the latter is longer than the arm 72 the construction has to be more massive, in view of the fact that the forces involved increase as a result of the length of the arm 72'. As shown in FIGS. 13, 13*a*, 14, this arm 72' takes the form of a fork with two branches and a handle or stock 122 common to the two branches, the arm being pivotable, like the lifting arm 72, about a horizontal axis A. The pivoting movement of this lifting arm 72' is effected by means of the hydraulic jack 74' mounted in the manner shown in FIGS. 13 and 14. As in the case of the lifting arm 72 the addition of a rod 124 parallel to the arm 72' enables the handling device 70 to form a parallelogram and to be given a constant orientation regardless of the angular position of the lifting arm 72'.

As may be seen from FIG. 14, the opening between the two branches 118 and 120 of the lifting arm 72' enables the handling device 70, particularly the arms 90 and 92 and the jack 106, to move freely, so that the lifting arm 72' can be lowered to a position beyond the horizontal, as shown in FIGS. 5 and 6.

Figure 16:
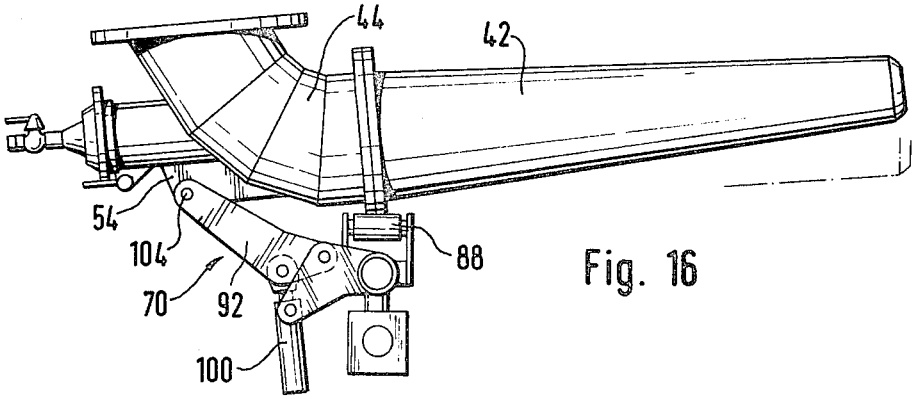

A description will now be given of the various ways in which the handling device 70 can be adjusted in the light of the different positions and angles of inclination which may be assumed by the elbow 44 and nozzle 42, as illustrated in FIGS. 15 to 19. For the purposes of the description reference will be made to a normal blast pipe, but the following considerations are equally valid for a blast pipe of the type 36'. It must first of all be borne in mind that the circular piping system 38 is not integral with the furnace, so that as a result of thermal expansions and deformations it may undergo displacement in relation to the furnace wall. It is therefore possible that on one side of the furnace it will be closer to the latter than on the opposite side. The blast pipes positioned on the side where the circular piping system is farther away from the furnace will therefore occupy an angular position of the kind shown in FIG. 15, whereas on the opposite side the blast pipes are positioned as illustrated in FIG. 16. The method of operation proposed in the foregoing for the self-propelling carriage is not impeded by this change in the angle of inclination of the nozzle 42 and of the elbow 44. The fact is that the rollers 86 (not shown in FIGS. 15 and 16) and 88 ensure that the elbow-and-nozzle assembly will be satisfactorily secured even if the flanges connecting the nozzle 42 to the elbow 44 and resting on these rollers are slightly inclined in relation to the latter.

The pivoting of the arms 90 (not shown in FIGS. 15 and 16) and 92, caused by the action of the jack 100, makes it possible, in conjunction with the oblong shape of the slot 108 in the bracket 54, to engage the pin 104 in the various angular positions liable to be occupied by the nozzle and to disengage it therefrom.

Figure 17:
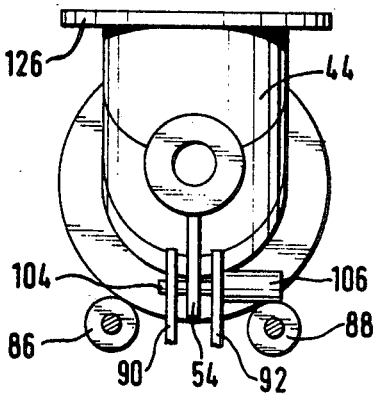
FIGS. 17,18 and 19 illustrate the operation of mounting or dismantling blast pipe components in different angular positions.
Figure 18:
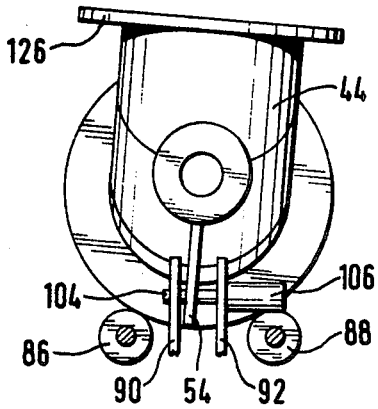
Figure 19:
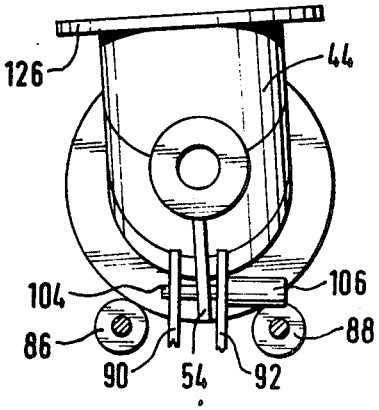

As a result of the angular expansion movements of the circular piping system 38, as well as the thermal deformations and expansions of the inclined descending part of the blast pipe, the elbow 44 and also the nozzle may occupy different angular positions, such as shown in FIGS. 17 to 19. These changes in position do not impede the mounting or dismantling of the lower part of the blast pipe by means of a carriage such as described in the foregoing. The fact is that the rollers 86 and 88, which can turn freely about their axis, are capable of supporting the assembly, whatever the angles of inclination, illustrated in particular in FIG. 18 or 19.

The distance left between the arms 90 and 92 defines the extreme limit positions in which the bracket 54 can still be affixed to the handling device 70. To enable the pin 104 to be engaged in each of the positions illustrated in FIGS. 18 and 19 all that is required is to select the size for the slot 108 in the bracket 54 in accordance with the diameter of the said pin 104. If the lower part of the blast pipe, when being dismantled, occupies a position such as that shown in FIG. 18 or that shown in FIG. 19, it is an easy task to turn the entire assembly until it reaches the position of FIG. 17, either for transport purposes or in order to place it in the position desired.

It is also possible to re-assemble the entire elbow-and-nozzle unit while it occupies one of the positions shown in FIG. 18 or 19 on the handling device 70, the lower flange of the descending part of the blast pipe being perfectly horizontal. For this purpose all that is required is to apply which ever side of the flange 126 of the elbow 44 is the higher, according to the orientation of the assembly, against the lower flange of the descending part 40 of the blast pipe, to engage one or two bolts through the two flanges in the region in which they are in contact and to actuate the jack 44 and/or the jack 100 until the moment when the flange 126 is completely applied against the adjacent flange of the descending part 40 in the blast pipe.

The following FIGS. 20 to 25 illustrate various transformations of the device 40 in order to adapt it in accordance with the component to handle.

Figure 20:
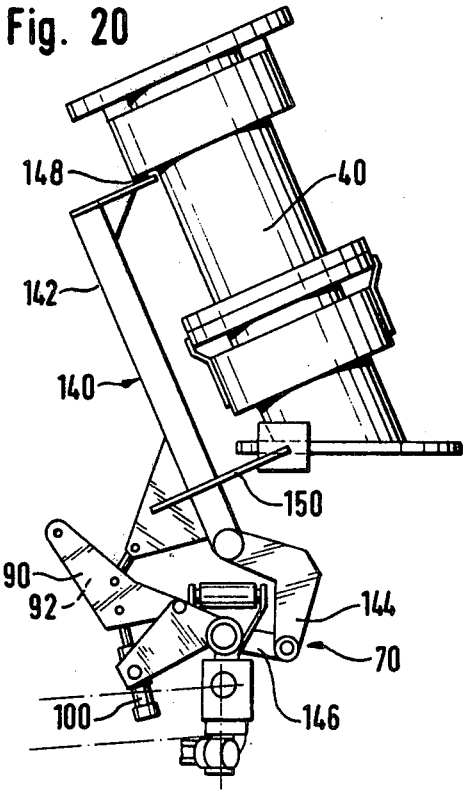
FIG. 20 is a schematic diagram of an adapter for the replacement of the descending part of a blast pipe.

The reference number 40 in FIG. 20 indicates the slanting descending part of the blast pipe, shown as a whole in FIG. 1.

The invention provides for an adapter 140 which can be temporarily associated with the handling device 70. This adapter 140 mainly consists of an ascending part 142, a catch pin 148 designed to engage an orifice provided for this purpose in the descending part 40, a cradle 150, on which the lower portion of the descending part 40 of the blast pipe rests freely, and also an intermediate arm 144. To enable use to be made of the handling device 70 described with reference to the preceding figures, all that is necessary is to provide means, known per se, to enable the adapter to be temporarily affixed to the handling device 70. For this purpose the handling device 70 may comprise, in particular, a tab 146 serving to secure the arm 144 in an intermediate position. This tab 146 may form part of the handling device 70, since it does not prevent the latter from being employed in the manner above. It should be noted that the ascending part 142, the intermediate arm 144 and the tab 146 may be either single or double.

The assembly shown in FIG. 20 makes it possible, by actuating the jack 100 to pivot the ascending part 142 about the point at which it is joined to the intermediate arm 144. The other adjustments of the adapter 140 are effected by means of the handling device 70 such as described above.

Figure 21:
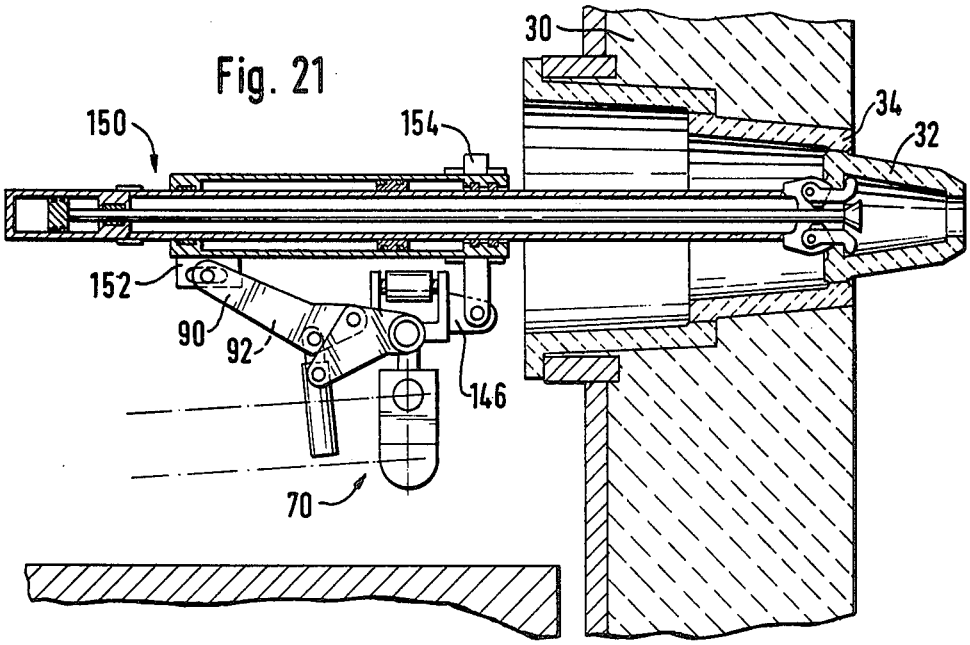
FIG. 21 is a schematic diagram of a side view of an adapter for a tuyere dismantling device.

FIG. 21 shows how a handling device 70 is used in conjunction with a device 150 serving to release and replace a tuyere 32. This device 150 is preferably of the kind described in Luxemburg Pat. No. 65 246, comprising two hydraulic or pneumatic cylinders, one serving to engage the tuyere and the other to release it from its seating on the tymp 34 in the wall of the furnace 30.

The device 150 can be mounted on the actual handling device 70 by means of a bracket 152 with a slot and a flange 154 which are provided on the said device 150 and designed to be affixed, respectively, to the arms 90, 92 and to the tab 146 of the handling device 70.

Figure 22:
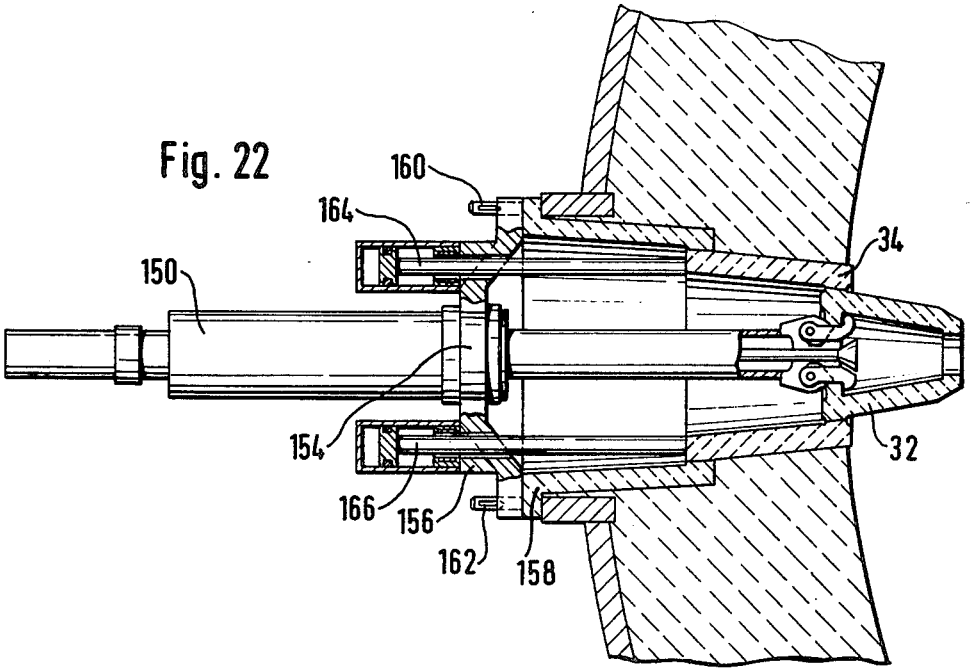
FIG. 22 is a schematic plan view of a support associated with the device shown in FIG. 21.

As may be seen from FIG. 22, the flange 154 is integral with a supporting bow 156 designed to be placed against the casing 158 in order to fix and immobilise the device 150 when the tuyere 32 is extracted. It is even possible to provide two cotters 160 and 162 in order to secure the supporting bow 156 against movement in either of the two directions, thus likewise enabling the device 150 to be immobilised when the tuyere 32 is being installed.

To prevent the tymp 34 from being pulled out when the tuyere 32 is being removed the supporting bow 156 can be completed by a system which bears on the said tymp 34. This object may be achieved by means known per se, particularly as shown in FIG. 22, by means of pistons 164, 166, applied against the tymp 34 by mechanical or hydraulic means.

Figure 23:
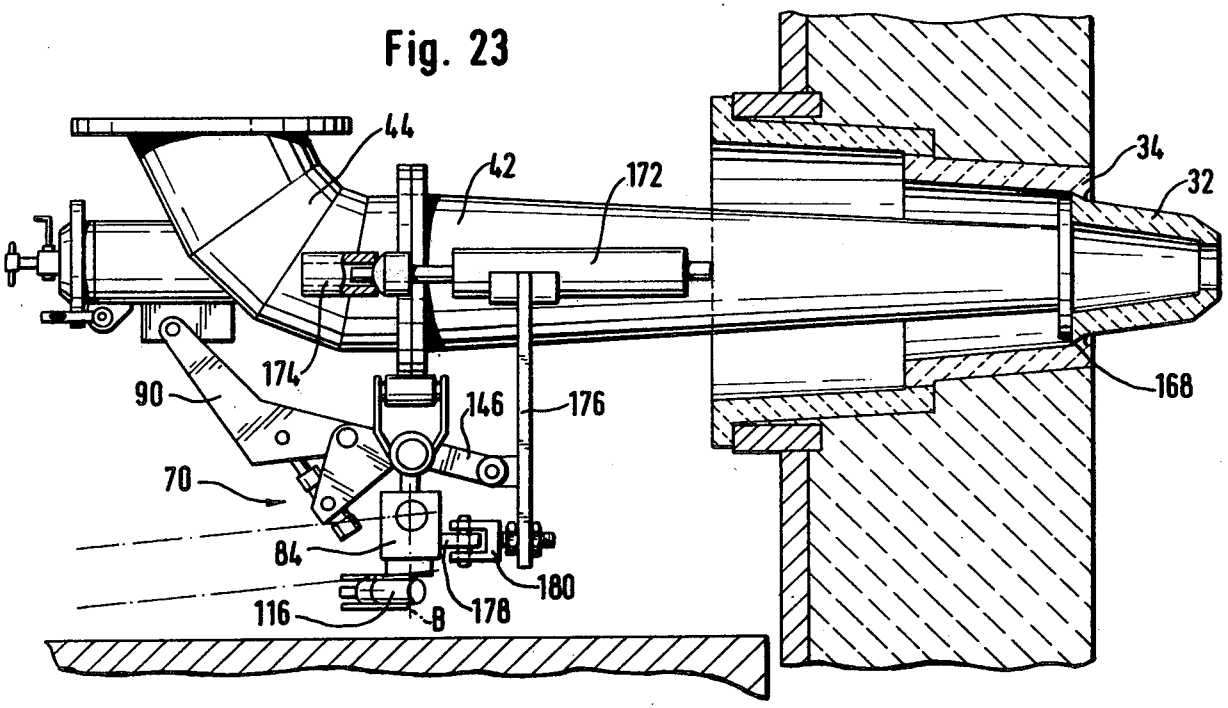
FIG. 23 is a schematic diagram of an adapter for dismantling tuyere, nozzle and blast pipe elbow all in one piece.
Figure 24:
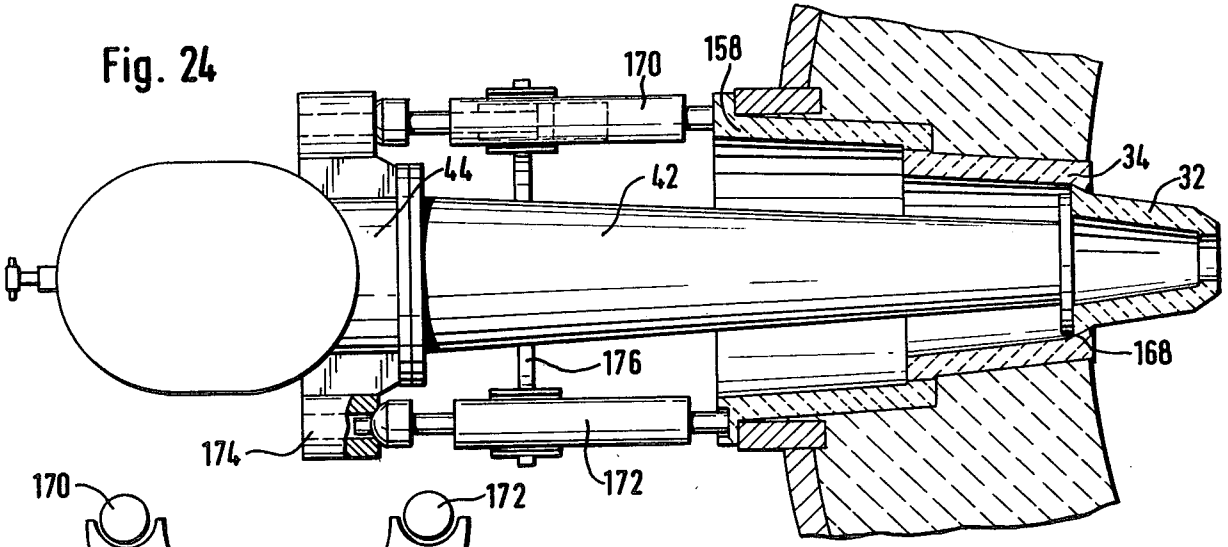
FIG. 24 shows details of the release and supporting means for the device shown in FIG. 23.
Figure 25:
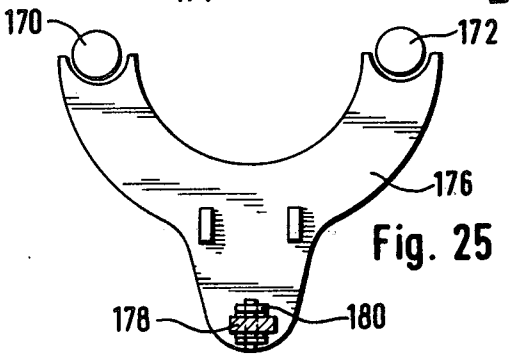
FIG. 25 shows details of a support for an adapter as shown in FIG. 23.

FIGS. 23–25 illustrate a device for dismantling and re-assembling the entire lower portion of a blast pipe of the kind described in U.S. Pat. No. 3,980,286. In the said Patent the tuyere 32 is integral with the nozzle 42, the resulting assembly being articulated to a shoulder of the tymp 34 by means of a spherical joint 168. The entire lower portion consisting of elbow 44, nozzle 42 and tuyere 32 can thus be disengaged. In this case, therefore, the nozzle 32 is no longer wedged onto its seating formed on the tymp 34. However, sincethe tuyere 32 is generally immersed in a mass of solidified slag or refractory material, it is still desirable and possibly even necessary to have available sufficient power to release and disengage the said tuyere 32. This motive force is provided, in the present invention, by two hydraulic or pneumatic jacks 170, 172, of which the piston and the cylinder bear respectively, on a shoulder 174 of the elbow 44 and on the casing 158, or vice versa. It should be noted that the shoulder 174 need not be specially constructed to enable the jacks 170, 172 to be applied against it, since the said shoulder 174 is provided, independently of these jacks, as a means of fixing straining members serving to secure the blast pipe and the tuyere in position.

The jacks 170, 172, are supported by a semi-circular cradle 176 attached to the tab 146 of the handling device 70. The cradle 176 is also fitted with a roller 178 mounted in a stirrup 180 in such a way as to bear on the upper surface of the supporting block 84 of the handling device 70. These rollers 178 thus roll over the external surface of the supporting block 84 when the jack 116 is actuated in order to cause the handling device 70 to rotate about the vertical axis B. The lower portion of the blast pipe is affixed to the device 70 in the manner described above.

It will be obvious that the versions described in the foregoing by reference to FIGS. 20–25 are equally applicable to a carriage of the type shown in FIG. 3 and to that shown in FIG. 4.

Figure 26:
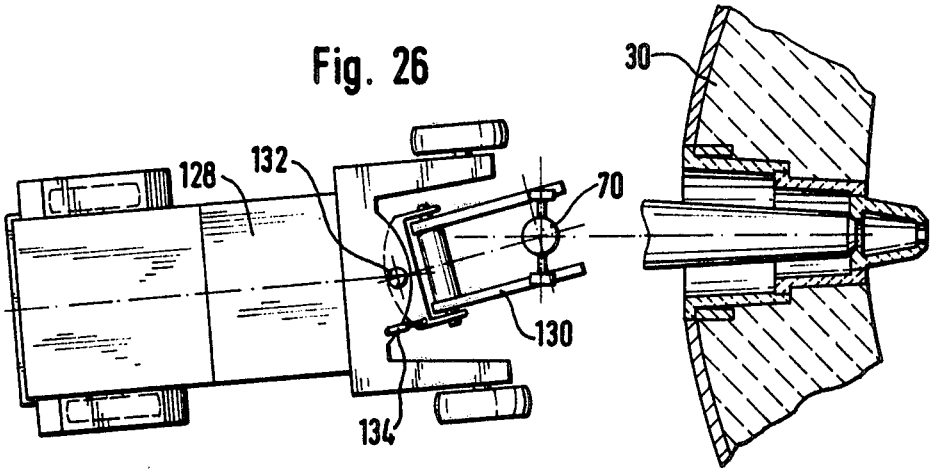
FIGS. 26 and 27 show how two different types of carriages are manipulated by the use of movements about two vertical swivel axes.

A description will now be given of the operation of a self-propelled carriage equipped with a handling device such as described in the foregoing, by reference to the preceding figures. FIG. 26 shows a carriage 128 of which the fore-carriage and the hind carriage are integral with each other, i.e. in which there is no central hinge such as described by reference to the preceding figures, particularly FIG. 3. This carriage 128 is therefore provided, in the conventional manner, with two front or rear steerable wheels, which may or may not be driving wheels. On the other hand, the assembly consisting of lifting arm and handling device 70 in this carriage is replaceable and is mounted on the fore-carriage of the carriage 128 via a hinge. This assembly can therefore pivot about a vertical axis marked 132. The lifting arm 130 may be of type 72 or 72'. The pivoting of the assembly about the axis 132 is effected by means of a hydraulic jack marked 134. One of the conditions which must be fulfilled to enable a tuyere or the lower part of a blast pipe to be mounted or dismantled is that the handling device 70 should be so positioned that the axis of the rollers 86 and 88 is approximately parallel to the axis of the tuyere. This alignment hitherto had to be achieved by aligning the carriage, generally consisting of a fork elevator, involving an accurate and very difficult manipulation on the part of the driver. The latter thus had to make several attempts in order to move the carriage into the correct position.

The present invention, on the other hand, enables the incorrect positioning or alignment of the carriage to be counteracted by the mobility of the handling device and of the lifting arm. As shown in FIG. 26, the axis of the carriage is completely out of alignment with that of the tuyere. Nevertheless, the pivoting of the lifting arm 130 about the axis 132 by means of the jack 134 enables the handling device 70 to be positioned correctly, and a simultaneous or subsequent rotation of this latter device about the axis B by means of the jack 116 (see FIGS. 9 to 12) effects the alignment which has not been obtained by means of the carriage 128. This naturally facilitates the operation of the said carriage 128, in view of the shortage of space for this maneuver on the platform.

Figure 27:
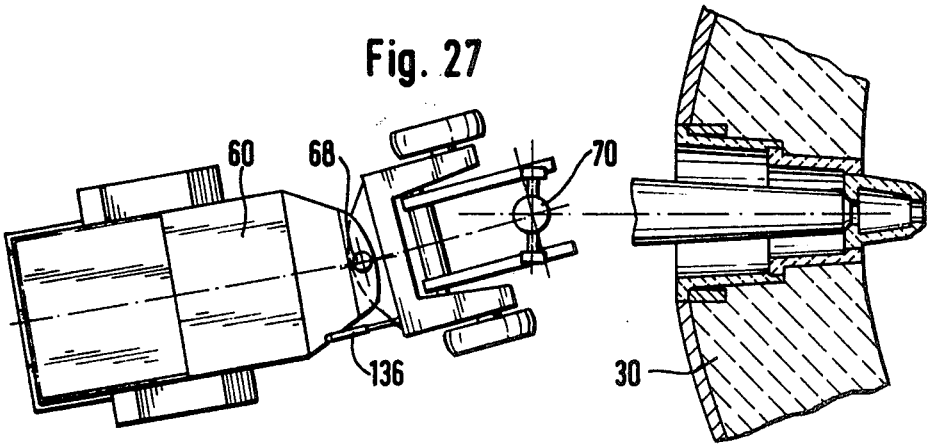

FIGS. 27 shows an arrangement similar to that illustrated in FIG. 26 but with a carriage 60 with a central hinge of the type shown in the preceding figures, particularly FIG. 3. In the case of the carriage 60 the operation of pivoting the lifting arm is effected together with the entire fore-carriage by means of the central hinge 68 and the action of the hydraulic jack 136. The operation of correcting the unsatisfactory positioning or alignment of the carriage 60 is nevertheless similar to that described in reference to FIG. 26 and consists of actuating the jack 136 and rotating the handling device 70 about its vertical axis B. The carriage 60 with a central hinge, however, offers the additional advantages of enabling the entire fore-carriage to be correctly aligned by means of a bending action on the level of the hinge 68. A bending action of this kind for example, positions the hinge 68 on the prolongation of the axis of the tuyere by means of a compound movement comprising the pivoting of the rear carriage in an anti-clockwise direction, as shown in FIG. 27, and the pivoting of the fore-carriage in a clockwise direction, about the centre of the handling device 70, kept in an approximately fixed position.

The carriage according to FIG. 27 offers the advantage of being rapidly and easily convertible, for example, into a mechanical shovel, by replacing the handling device 70 by a suitable working tool, in this case a shovel. This enables the carriage to be used and oprated when not required for the maintenance of the blast pipes.

The carriage according to the present invention thus consists of a combination of the working tool and a control apparatus which, in the case of FIG. 27, consists of the hind carriage of a tractor or carriage known per se. This hind carriage or control apparatus comprises the rear wheels, the driver's cabin, the motor and an assembly for the production and distribution of hydraulic energy. This control apparatus or hind carriage being known per se and constituting a standard element, usually manufactured in quantity, enables the cost price of the carriage for the maintenance of the blast pipes to be considerably reduced, in view of the fact that it is not necessary to design a whole carriage but merely a working tool or handling device which can be fitted to a control apparatus of a mass-produced type.

The carriage is preferably of the hydrostatic type, known per se, i.e. the displacement and mobility derive from hydraulic motors incorporated in the driving and/or steerable wheels. This enables a piping system to be designed and the system to be manipulated on far more flexible lines than the conventional equipment.

A particularly valuable advantage of the carriage with a central hinge as shown in FIG. 27 is that the second swivel axis is rendered identical with the axis of the central hinge, so that the action of pivoting the handling device about the second swivel axis and the manipulation or steering of the carriage constitute identical operations which can be carried out by one single hydraulic jack. In other words the resulting advantage is the saving of one control mechanism.

I claim:

1. Apparatus for supporting and positioning components of a system for the injection of gas into a shaft furnace comprising:

elongated lifting arm means;

component handling means for releasable supporting and positioning a component of a gas injection system, said component handling means being mounted on said arm means adjacent a first end thereof and being pivotal with respect to said arm means about a first vertical axis;

lifting arm support means, said arm means being movable with respect to said support means to provide for raising and lowering of said component handling means, said support means further being pivotal about a second vertical axis; and control means for releasably engaging said support means, said control means coupling said support means to said control means adjacent the second end of said arm means, said control means including detachable hinge means which defines said second vertical pivot axis.

2. The apparatus of claim 1 where said lifting arm support means comprises a movable fore-carriage and wherein said control means forms a rear carriage, the fore-carriage being pivotal with respect to the rear carriage through the action of said detachable hinge means.

3. The apparatus of claim 2 wherein said lifting arm means includes a base portion and a pair of parallel branches extending from said base portion, said component handling means being mounted between said lifting arm means branches, the base of said lifting arm means being mounted on and being pivotal with respect to a shaft supported by said arm support means whereby said component handling means may be raised and lowered.

4. The apparatus of claim 1 further comprising:

guide rod means including a guide rod, said guide rod being parallel to said lifting arm means in all positions of said lifting arm means, one end of said guide rod being pivotally connected to said lifting arm support means, the other end of said guide rod being pivotally connected to said component handling means, said rod maintaining said first axis in a vertical orientation as the lifting arm means is raised and lowered.

5. The apparatus of claim 1 wherein said second vertical axis intersects a line through the center of said arm support means.

6. Apparatus for supporting and positioning components of a system for the injection of gas into a shaft furnace comprising:

elongated lifting arm means, said lifting arm means being at least in part U-shaped, said U-shaped arm means being defined by a pair of elongated arms each of which has a first end and a second end, the second ends of said arms being interconnected by a shaft;

component handling means for releasably supporting and positioning a component of the gas injection system, said component handling means being mounted on said lifting arm means adjacent the first ends of said arms, said component handling means being pivotal with respect to said lifting arm means about a first vertical axis; and lifting arm support means, said elongated lifting arm means being coupled to said support means by said shaft, said lifting arm means being pivotal about said shaft to raise and lower said component handling means, said lifting arm support means being pivotal about a second vertical axis.

7. The apparatus of claim 6 further comprising:

guide rod means including a guide rod, said guide rod being parallel to said lifting arm means in all positions of said lifting arm means, one end of said guide rod being pivotally connected to said lifting arm support means, the other end of said guide rod being pivotally connected to said component handling means, said rod maintaining said first axis in a vertical orientation as the lifting arm means is raised and lowered.

8. The apparatus of claim 6 wherein said second vertical axis intersects a line through the center of said arm support means.

9. Apparatus for supporting and positioning components of a system for the injection of gas into a shaft furnace comprising:

elongated lifting arm means;

component handling means for releasably supporting and positioning a component of the gas injection system, said component handling means being mounted on said lifting arm means adjacent a first end thereof and being pivotal with respect to said arm means about a first vertical axis, said component handling means including at least a pair of supporting rollers, each of said rollers defining an axis, the axes of said rollers being substantially parallel to each other and defining a horizontal plane; and lifting arm support means, said elongated lifting arm means being coupled to said support means adjacent the second end of said arm means, said arm means being movable with respect to said lifting arm support means to provide for raising and lowering of said component handling means, said lifting arm support means further being pivotal about a second vertical axis.

10. The apparatus of claim 7 wherein said second vertical axis intersects a line through the center of said arm support means.

11. Apparatus for supporting and positioning components of a system for the injection of gas into a shaft furnace comprising:

elongated lifting arm means;

component handling means for releasably supporting and positioning a component of the gas injection system, said component handling means being mounted on said lifting arm means adjacent a first end thereof and being pivotal with respect to said arm means about a first vertical axis;

self-propelled carriage means, said carriage means including chassis means, said chassis means having wheels and being mobile; and hinge means for detachably coupling said chassis means to said elongated lifting arm means adjacent the second end of said arm means, said arm means being movable with respect to said carriage means to provide for raising and lowering of said component handling means, said hinge means defining a second vertical axis about which said lifting arm means may be pivoted whereby said component handling means may be pivoted with respect to said chassis means.

12. The apparatus of claim 11 wherein said chassis means includes a rear carriage and a fore-carriage, said hinge means coupling said rear carriage to said fore-carriage.

13. Apparatus for supporting and positioning components of a system for the injection of gas into a shaft furnace comprising:

elongated lifting arm means;

component handling means for releasably supporting and positioning a component of the gas injection system, said component handling means being mounted on said lifting arm means adjacent a first end thereof and being pivotal with respect to said arm means about a first vertical axis, said component handling means including a pair of parallel arms, said component handling means parallel arms being pivotal about a substantially horizontal axis, said component handling means further including means for connecting a component of the gas injection system to said parallel arms; and lifting arm support means, said elongated lifting arm means being coupled to said support means adjacent the second end of said lifting arm means, said lifting arm means being movable with respect to said lifting arm support means to provide for raising and lowering of said component handling means, said lifting arm support means further being pivotal about a second vertical axis which intersects a line through the center of said lifting arm support means.

14. The apparatus of claim 13 further including:

a first hydraulic jack for causing movement of said component handling means about said first vertical axis; and a second hydraulic jack for causing movement of said parallel arms about said horizontal axis.

15. The apparatus of claim 12 wherein said means for connecting a component of the gas injection system to said component handling means parallel arms comprising a prolongation of a piston rod of a hydraulic jack mounted on one of said component handling means parallel arms.

16. The apparatus of claim 15 further including a plurality of tools, said tools being releasably attachable to said component handling means, said tools selectively engaging components of the gas injection system and coupling said engaged components to said component handling means.

17. The apparatus of claim 16 wherein at least one of said releasable tools comprises an ascending part pivotally attached to said component handling means, said ascending part being fitted with a catch pin and a cradle, said cradle serving to support a descending portion of a blast pipe.

18. The apparatus of claim 16 wherein at least one of said tools comprises a semicircular cradle having a pair of arms, said cradle being articulated to said component handling means, said cradle arms each supporting one of a pair of hydraulic jacks, said cradle permitting dismantling of an assembly formed by the elbow, nozzle and tuyere of a blast pipe.

19. The apparatus of claim 18 wherein the opposite ends of said hydraulic jacks are applied respectively to a casing associated with said component handling means and to a shoulder provided on the elbow of a blast pipe.

20. The apparatus of claim 16 wherein at least one of said tools comprises a device for the withdrawal and installation of a tuyere, said tuyere installation tool including a slotted bracket and a flange, said bracket and flange being connected to said component handling means.

21. The apparatus of claim 20 wherein said flange is integral with a supporting bow, said supporting bow being capable of being applied to the casing of a tuyere.

22. The apparatus of claim 21 further including means coupled to said supporting bow for preventing displacement of said bow in a longitudinal direction with respect to a tuyere to be installed.

23. The apparatus of claim 22 further including a support adapted for application to a tymp which receives the tuyere.

* * * * *

UNITED STATES PATENT AND TRADEMARK OFFICE

CERTIFICATE OF CORRECTION

PATENT NO. : 4,266,907

DATED : May 12, 1981

INVENTOR(S) : Pierre Mailliet

It is certified that error appears in the above-identified patent and that said Letters Patent are hereby corrected as shown below:

Column 13, line 45 (Claim 10, line 1), "claim 7"
should be --claim 9--

Column 14, line 39 (Claim 15, line 1), "claim 12"
should be --claim 13--

Signed and Sealed this

*Sixteenth* Day of *March 1982*

[SEAL]

*Attest:*

GERALD J. MOSSINGHOFF

*Attesting Officer*

*Commissioner of Patents and Trademarks*